US007903104B2

(12) United States Patent
Chen et al.

(10) Patent No.: US 7,903,104 B2
(45) Date of Patent: Mar. 8, 2011

(54) SPATIAL MODULATOR DISPLAY SYSTEM USING TWO MEMORIES AND DISPLAY TIME SLICES HAVING DIFFERING TIMES

(75) Inventors: Chih-Liang Chen, Saratoga, CA (US); Alex Hung-Pin Sun, Cupertino, CA (US)

(73) Assignee: Spatial Photonics, Inc., Sunnyvale, CA (US)

( * ) Notice: Subject to any disclaimer, the term of this patent is extended or adjusted under 35 U.S.C. 154(b) by 1017 days.

(21) Appl. No.: 11/689,464

(22) Filed: Mar. 21, 2007

(65) Prior Publication Data

US 2008/0231568 A1 Sep. 25, 2008

(51) Int. Cl.
*G09G 3/34* (2006.01)

(52) U.S. Cl. ..... 345/204; 345/84

(58) Field of Classification Search ..... None
See application file for complete search history.

(56) References Cited

U.S. PATENT DOCUMENTS 5,278,652 A * 1/1994 Urbanus et al. ..... 348/571
6,008,785 A * 12/1999 Hewlett et al. ..... 345/85
6,115,083 A * 9/2000 Doherty et al. ..... 348/771
6,118,500 A 9/2000 Kunzman
6,226,054 B1 * 5/2001 Morgan et al. ..... 348/759
6,611,260 B1 * 8/2003 Greenberg et al. ..... 345/204
6,970,150 B2 11/2005 Hewlett et al.
6,972,773 B2 * 12/2005 Matsui et al. ..... 345/611
6,992,810 B2 1/2006 Pan et al.
7,167,298 B2 1/2007 Pan
2005/0184938 A1 * 8/2005 Hewlett et al. ..... 345/84
2007/0058087 A1 * 3/2007 Kettle et al. ..... 348/742

* cited by examiner

*Primary Examiner* — Amare Mengistu
*Assistant Examiner* — Antonio Xavier
(74) *Attorney, Agent, or Firm* — Fish & Richardson P.C.

(57) ABSTRACT

A spatial light modulator having two static random access memory (SRAM) devices, including a display controller configured with a display sequence, the display sequence including a first display slice and a second display slice, the first display slice having a display time less than two times a minimum time period determined by the time of a write event, and the second display slice having a display time of more than two times the minimum time period. The controller controls write events from the two SRAM devices, and the first display slice and second display slice are ordered in the display sequence so that the controller causes the spatial light modulator to output light and causes the two SRAM devices each to perform a write event during the second display slice.

15 Claims, 6 Drawing Sheets

Pixel Cell

SPATIAL MODULATOR DISPLAY SYSTEM USING TWO MEMORIES AND DISPLAY TIME SLICES HAVING DIFFERING TIMES

BACKGROUND

The present disclosure relates to spatial light modulators.

A micro mirror array is a type of spatial light modulator (SLM) device that includes an array of pixel cells, each of which includes a mirror plate that can tilt about an axis and, furthermore, circuitry for generating electrostatic forces that can tilt the micro mirror plate. In a digital mode of operation, for example, the mirror plate can be tilted and stopped at two positions. In an "on" position, a micro mirror reflects incident light toward a display surface to form an image pixel in an image display. In an "off" position, the micro mirror directs the incident light away from the image display. Driving circuits for the micro mirror array can be fabricated in a silicon substrate, typically referred as the back plane of the SLM device. An SLM device needs to perform at least two basic functions: transferring digital data for the next image to be displayed to the silicon backplane (i.e., "write"), and converting the data into electrical signals to control the positions of the micro mirrors to modulate the incident light (i.e., "display").

SUMMARY

In a general aspect, a spatial light modulator system is described that includes an array of pixel cells each that includes two static random access memory (SRAM) devices each of which can store digital data and perform a write event that takes a minimum time period, a spatial light modulator configured to output light in an on direction or an off direction according to the write event and a controller configured with a display sequence, the display sequence including a first display slice and a second display slice, the first display slice having a display time less than two times the minimum time period and the second display slice having a display time of more than two times the minimum time period, wherein the controller controls write events from the two SRAM devices, and the first display slice and second display slice are ordered in the display sequence so that the controller is configured to cause the spatial light modulator to output light and the two SRAM devices to each perform a write event during the second display slice.

In another general aspect, a spatial light modulator system is described that includes an array of pixel cells each including two static random access memory (SRAM) devices each of which can store digital data and output a first voltage signal in response to the digital data, a level shifter that can receive the first voltage signal from at least one of the two SRAM devices and output a second voltage signal, and a tiltable micro mirror plate supported by a substrate and one or more electrodes under the micro mirror plate, wherein the one or more electrodes can receive the second voltage signal from the level shifter and, the micro mirror plate can tilt a predetermined position in response to the second voltage signal.

In yet another general aspect, a method for controlling an array of SLMs in response to a digital image is described. The method includes dividing a color field of the digital image into a plurality of bit planes including a first bit plane, a second bit plane, and a third bit plane; displaying the first bit plane by controlling an SLM in the array to a predetermined position; writing data associated with the second bit plane to a first static random access memory (SRAM) device and data associated with the third bit plane to a second SRAM device during the displaying of the first bit plane; after the displaying of the first bit plane, displaying the second bit plane by controlling the SLM in the array to the predetermined position in accordance with the data written to the first SRAM device; and after the displaying of the second bit plane, displaying the third bit plane by controlling the SLM in the array to the predetermined position in accordance with the data written to the second SRAM device.

Implementations of the system may include one or more of the following. The first voltage signal can be in the range of about 1.3 to 2.3 volts. The second voltage signal can be in the range of about 4 to 6 volts. The spatial light modulator can include a tiltable micro mirror plate supported by a substrate and one or more electrodes under the micro mirror plate. The micro mirror plate can receive a third voltage signal. The one or more electrodes can receive the second voltage signal from the level shifter. The micro mirror plate can tilt in response to a third voltage signal and second voltage signal. The third voltage signal can be in the range of about 15 to 50 volts, such as between about 20 and 40 volts. The spatial light modulator system can further include a multiplexer that can select one of the two SRAM devices in response to an external signal, wherein a selected SRAM of the two SRAM devices can write data to the level shifter. The level shifter can receive a global reset signal and reset the spatial light modulator to a predetermined position in response to the global reset signal. The spatial light modulator can include a tiltable micro mirror plate supported by a substrate, wherein the micro mirror plate can tilt to an on position to direct the light in the on direction or an off position to direct the light to the off direction in response to the global reset signal. The level shifter can include a plurality of MOSFET devices. Two of the plurality of MOSFET devices in the level shifter can form a cross-coupled latch. Each of the at least two SRAM devices can include a plurality of MOSFET devices.

The disclosed SLM system can include one or more of the following advantages. The disclosed SLM system may provide a higher data writing rate than conventional SLM systems. Image data are stored by two or more SRAMs for each pixel cell. The image data stored on the two or more SRAMs can be written to the SLM in the pixel cell while an image is displayed by the SLM. The image data can thus be ready for the next display event once the current display event is completed. The non-display times may be reduced or eliminated in comparison with the conventional SLM systems.

The disclosed system and methods are particularly beneficial for high resolution and high bit-depth display applications. These applications tend to have long non-display times because of the longer data write times associated with the large pixel arrays and/or the short display times in the low bit displays, which tend to produce larger portion of non-display times in image frames. The disclosed system and methods can effectively reduce the non-display times in these applications.

Another potential advantage of the disclosed system is that it may consume less power than conventional SLM systems by writing data to the pixel cells using lower-voltage signals. The lower-voltage signals are converted to median voltage signals by level-shifters, wherein the median-voltage signals are used to drive the SLMs. Furthermore, the circuits in the disclosed SLM system can be implemented without increasing the sizes of the pixel cells.

Although the invention has been particularly shown and described with reference to multiple embodiments, it will be understood by persons skilled in the relevant art that various changes in form and details can be made therein without departing from the spirit and scope of the invention.

BRIEF DESCRIPTION OF THE DRAWINGS

The following drawings, which are incorporated in and form a part of the specification, illustrate embodiments of the present invention and, together with the description, serve to explain the principles, devices and methods described herein.

DETAILED DESCRIPTION

Figure 1:
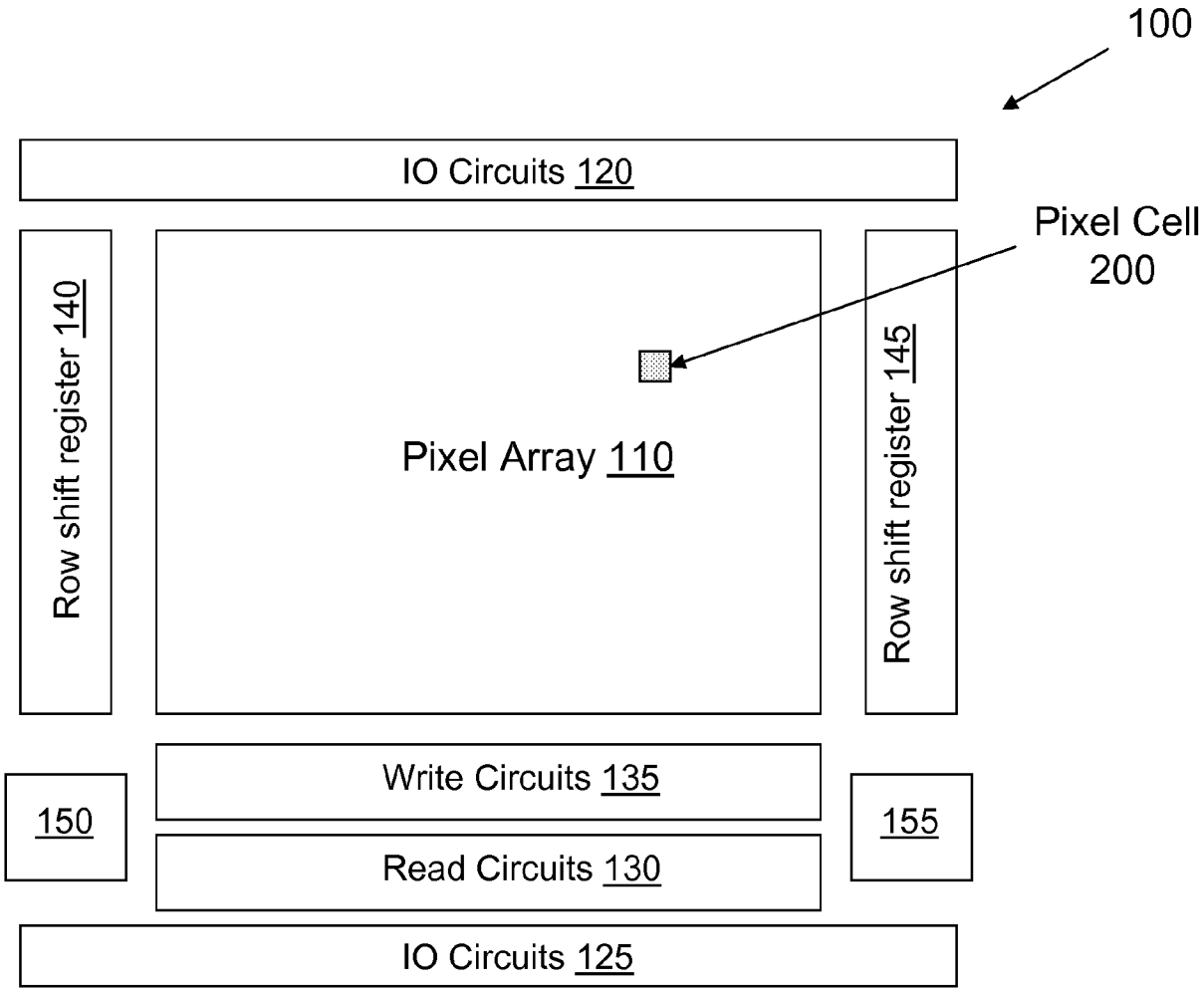
FIG. 1 is a block diagram of the circuits for driving an array of spatial light modulators (SLMs) in an SLM system.

Referring to FIG. 1, an SLM system 100 can include a pixel array 110 that includes pixel cells 200. The SLM system 100 can also include input and output (IO) circuits 120 and 125 for receiving digital image data and control signals, read circuits 130 for reading data from the array for testing purposes, and write circuits 135 for writing data to the pixel cells 200. The SLM system 100 can also include row shift registers 140, 145 for controlling data writing to different rows of pixel cells 200 and read/write (RW) logic controls 150 and 155 for controlling the directions of the data flow for reading and writing operations.

Figure 2A:
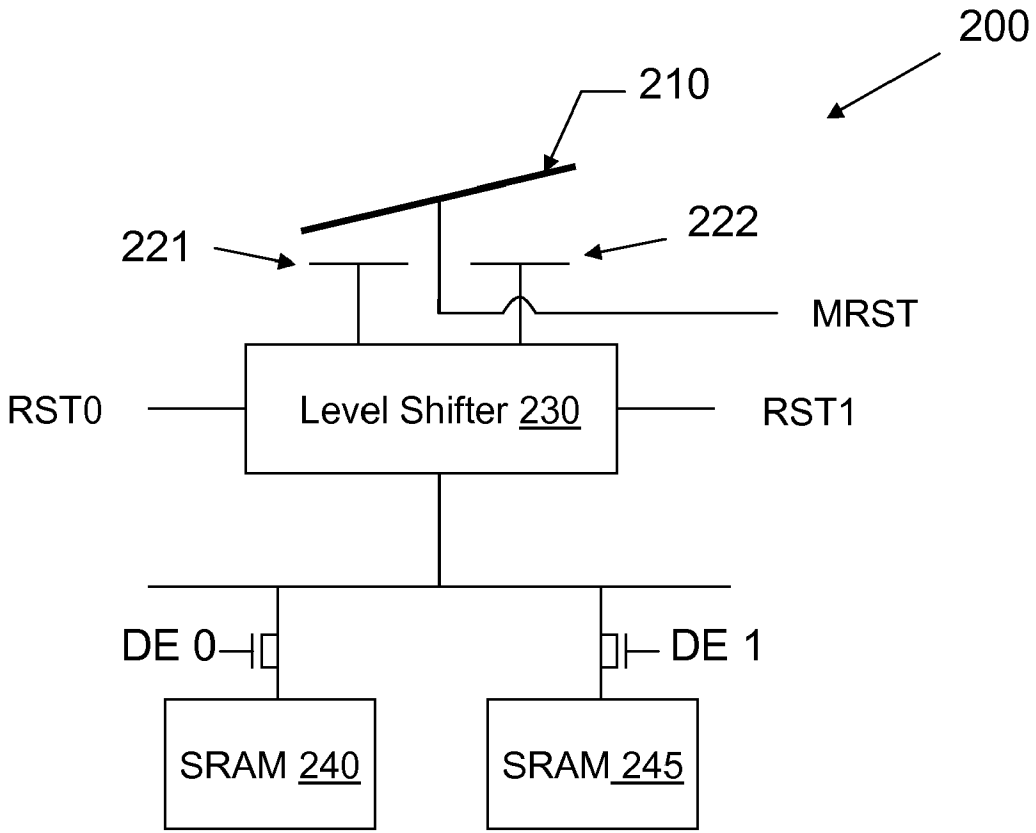
FIG. 2A is a schematic diagram of a pixel cell in the spatial light modulator of FIG. 1.

The pixel cell 200, referring to FIG. 2A, can include a micro mirror 210 and electrodes 221, 222 under the micro mirror 210. The micro mirror 210 and the electrodes 221, 222 can be fabricated on a substrate. In some embodiments, the SLM system 100 including the various above described driving circuits, the micro mirror 210, and the electrodes 221, 222 can be fabricated on a single semiconductor substrate instead of being fabricated on separate substrates that are bonded together. A level shifter 230 can provide voltage signals to control the electric potentials of the electrodes 221, 222. The amplitude of the voltage signals provided by the level shifter 230 can, for example, be in the range of about 4 to 6 volts, or 5 V. The voltage range of 4 to 6 volts can be referred to as the median-voltage range in the present specification. In comparison, a "high-voltage" signal in the present specification refers to a voltage signal above 10 volts, such as between about 15 and 50 volts, or between about 20 and 40 volts. A "low-voltage" signal in the present specification refers to a voltage signal below 4 volts, such as between about 2 and 3 volts.

During operation, a high-voltage mirror rest signal (MRST) can be applied on an MRST line to a conductive portion in the micro mirror 210 to tilt the micro mirror. The MRST line is biased with a voltage amplitude in the range of about 15 to 50 volts, and is pulsed in the range of about −20 to −40 volts to tile the mirror. For example, the MRST can be biased at a high DC voltage of about 30V, and switched to a high negative voltage of about −30 V for a short period of time, such as less than 5 microseconds, to cause the mirror to tilt.

The pixel cell 200 also includes two static random access memories (SRAMs) 240, 245 that can receive input data from the write circuits 135. The data stored in the SRAMs 240 and 245 can be multiplexed to the level shifter 230 under the control of the display enable signals "DE0" and "DE1". Two global resets "RST0" and "RST1" can reset the level-shifters 230 in all pixel cells 200 in the SLM system 100 to simultaneously set the micro mirrors 210 in the whole array to "on" positions or "off" positions. The data signals from the SRAMs 240 and 245 are low voltage signals, which can have amplitudes in the range of about 1.3 to 2.3 volts, or 1.8 V.

The level-shifter 230 can convert the low voltage signals from the SRAMs 240 and 245 to median-voltage signals (e.g., 5V), which are subsequently sent to the electrodes 221 and 222. The median voltage signals applied to the electrodes 221 and 222 and the high-voltage mirror reset signal "MRST" signal can produce an appropriate electro potential difference between the micro mirror 210 and the electrodes 221, 222 for resetting the mirrors. That is, the resulting electrostatic forces can tilt the micro mirror 210 to an "on" position or an "off" position such that incident light can be directed toward or away from an image display.

Figure 2B:
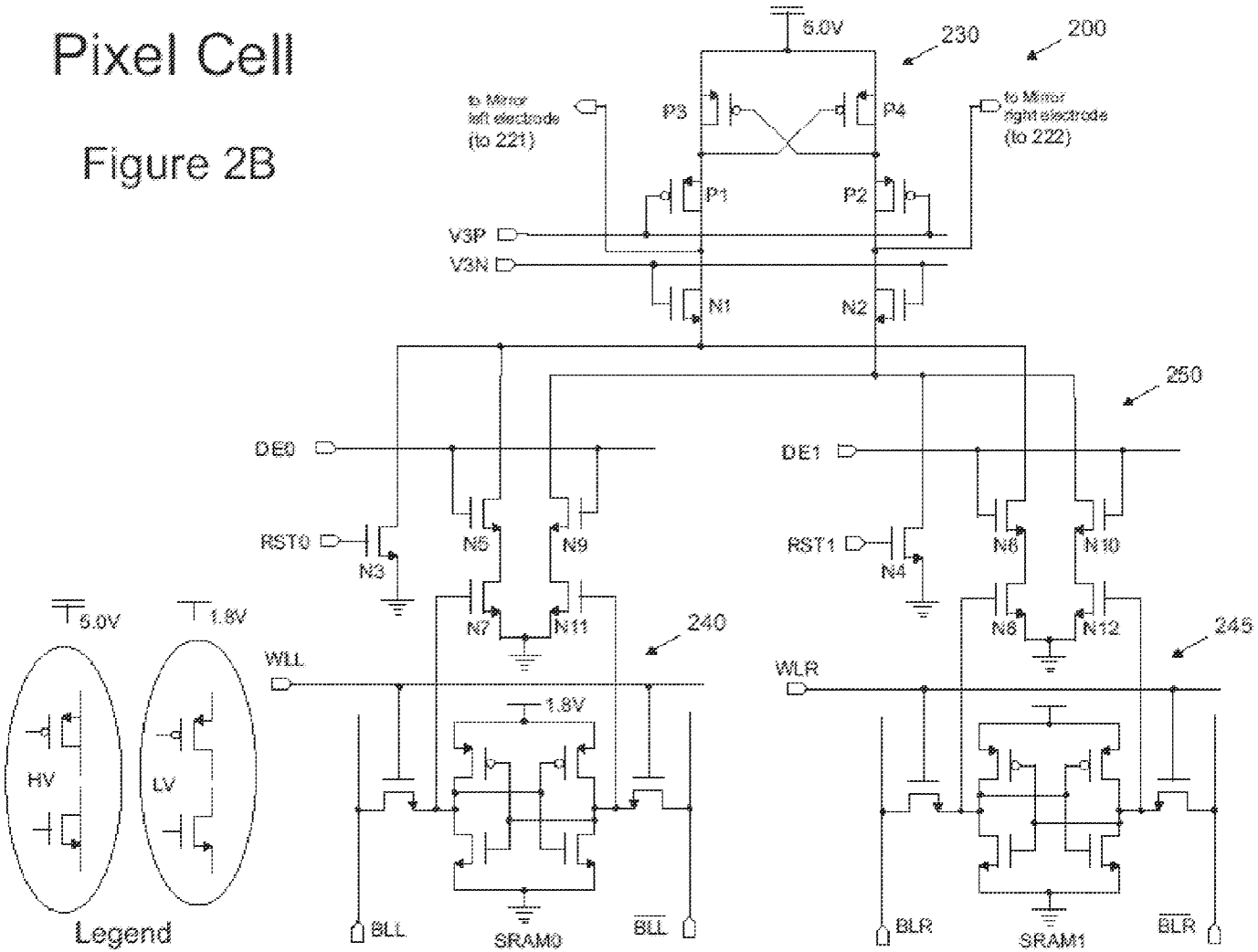
FIG. 2B shows exemplified circuit schematics for the pixel cell of FIG. 2A.

FIG. 2B shows an exemplary detailed circuit of the pixel cell 200. A level shifter 230 includes high voltage MOSFET devices P1-P4, N1, and N2. P3 and P4 form a cross-coupled latch. P1, P2, N1, and N2 are included to increase device reliability. The pixel cell 200 also includes SRAMs 240, 245 each including six MOSFET transistors. A low voltage n-channel, 2-way multiplexing circuit 250 in the middle of the pixel cell 200 can select which of SRAMs 240, 245 to connect to the level-shifter 230 under the control of the display enable signals "DE0" and "DE 1". The display enable signals "DE0" and "DE 1" are controlled by a controller, which is described further below. The pixel cell 200 can include two global reset signals "RST0" and "RST1" for resetting or presetting all the micro mirrors 210 in a mirror array. The pixel cell 200 can be implemented in a 10 μm by 10 μm or smaller pixel by using advanced 0.18 μm CMOS technologies. For example, the level-shifter 230 can occupy about 40% of the area in a pixel cell. Low-voltage devices including the SRAMs 240, 245 and the multiplexing circuit 250 can occupy about 60% of the area in the pixel cell.

Figure 3:
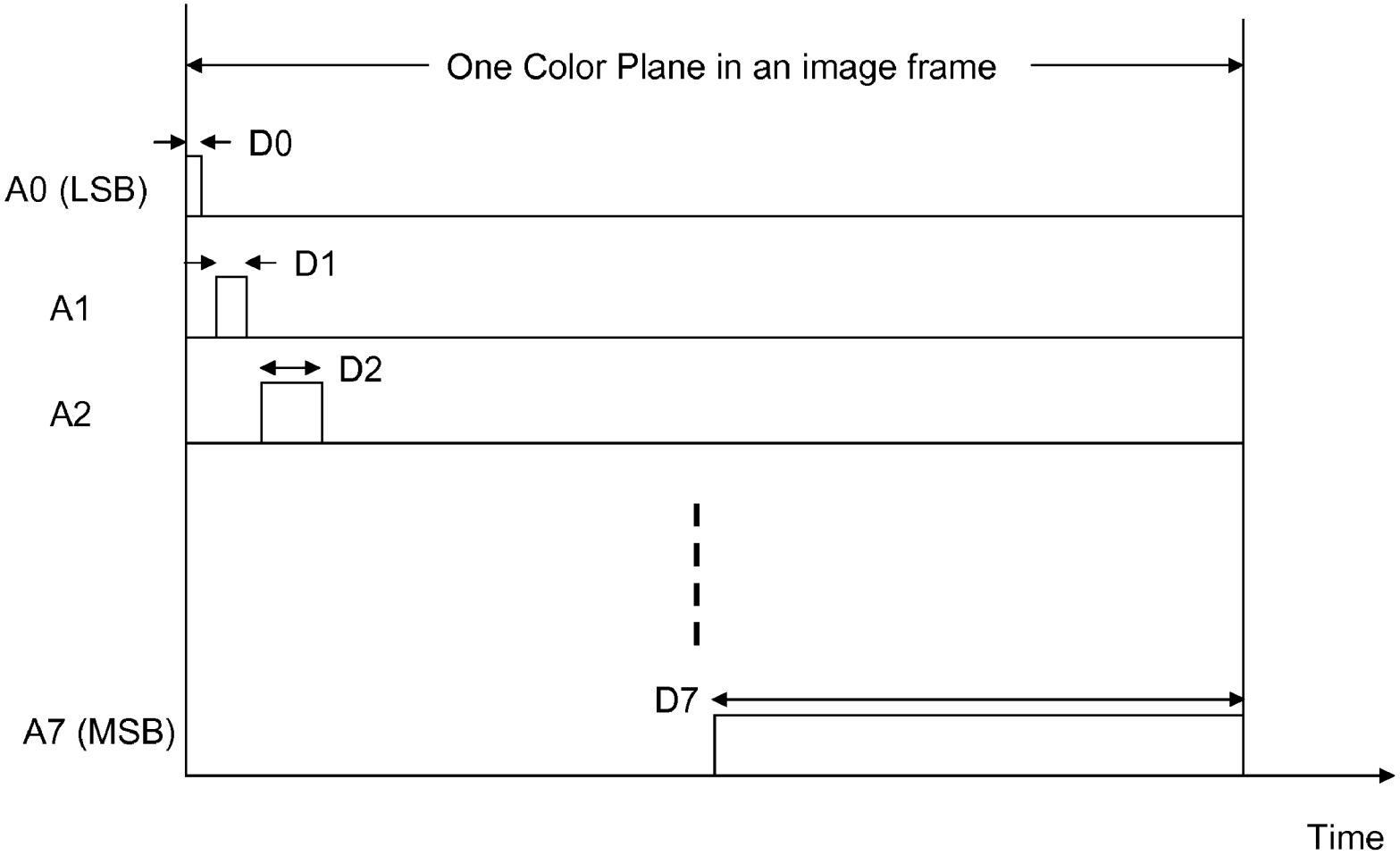
FIG. 3 is a schematic illustration of display times for binary display bits A0, A1, A2 . . . and A7 in a color plane in an SLM system.

The SLM system 100 and the pixel cell 200 operate as follows. Data updating for the SRAM 240 and 245 can be referred as a "write" event. As an example, assume that the write time for each SRAM 240 or 245 is 100 μs. The mirror reset time can be 10 μs for turning on (MRST_on) or turning off (MRST_off) the micro mirror 210. To display pixels of an image at different intensities, the micro mirrors 210 in different pixel cells 200 can direct light toward the display for different time durations in accordance with input image data at the different pixels. For 8-bit intensity resolution, the display duration of each micro mirror 210 for an image pixel can be achieved by a combination of eight binary bits. Each of the bits is associated with a bit plane A0, A1, A2 . . . , A7 of the image, and each bit plane has an associated total display time D0, D1, D2 . . . , D7, as shown in FIG. 3. The display time D0 for the A0 bit plane can be 10 μs. The display times D1, D2 . . . , D7 can be successively increased by a factor of 2: D1 (20 μs), D2 (40 μs), D3 (80 μs), D4 (160 μs), D5 (320 μs), D6 (640 μs), and D7 (1280 μs). A0 can be referred to as the least significant bit (LSB); A7 the most significant bit (MSB). If a micro mirror is "on" in the A0 bit plane (binary 0000 0001 in the image data), the micro mirror will be on for 10 μs. If a micro mirror is "on" in both the A1 and A0 bit planes (binary 0000 0011 in the image data), the micro mirror will be on for 30 μs. It should be noted that the disclosed systems and methods can be compatible with other bit plane schemes for displaying the color field of an image. For example, the bit planes for a color field do not have to be based on a binary system. The time durations of the bit planes can be related to each other by factors different from two as in a binary system. Moreover, the successive bit planes do not have to be scaled by a constant factor.

A display image can include one (e.g., a monotone image) or a plurality (an image including red, green, and blue colors) of color fields (also referred as "color planes"). A color field of a digital image can be divided into a plurality of (such as 10 to 40) display slices. Each display slice represents a period of time for display of a particular bit plane, although some bit planes may require multiple display slices. One of the bit planes with a display time longer than the write time can be selected to define a base display time. The selected and less significant bit planes (i.e., bit planes with display times equal to or less than the base display time) can use one display slice each, whereas bit planes that are more significant (and have display times longer than the base display time) can use multiple display slices. In particular, a more significant bit plane can occupy a number of display slices equal to the display time for the more significant bit plane divided by the display time for the base display time. For example, the display time D5 for the A5 bit slice can be selected as the base display time. Longer display times, e.g., display times D6 and D7 for the A6 and A7 bit slices, can be divided into slices each having a duration equal to the base display time.

In a conventional system, each display slice has the same duration and the time period for a display slice can be called slice-display time. For example, the base display time can be chosen to be the A5 display time, D5. Thus the slice-display time is the time period D5 for the A5 bit plane (e.g., 320 μs). One criterion for the slice-display time for a conventional display device (that includes a single memory device in a pixel cell) is that the slice-display time needs to be longer than the write time for the display device. For example, in a device with SRAM, the SRAM write time may be 100 μs, shorter than the unit display time of 320 μs. A longer bit plane such as "A7" or "A6" can be derived from a multiple of slice-display times. The A7 bit plane can be separated into four-display slices each lasting 320 μs. The A6 bit plane can be separated into two-display slices each lasting 320 μs. The slice-display scheme based on the A5 bit plane requires a total of twelve display slices for each color field: six display slices for the A0-A5 bit planes, two slices for the A6 bit plane and four slices for the A7 bit plane.

A display sequence is an order of the presentation of display slices for the bit planes. The display slices of the highly significant bit planes (e.g., the A7 and A6 bit planes in the example) can be distributed evenly across the display sequence for better display uniformity and reducing display artifacts, such as color break-up and flicker. The display slices of the less significant bit planes (e.g., the A0, A1 . . . , A5 bit planes in the example) can be assigned to fill the gaps between the display slices of the more significant bit planes. For example, the display sequence for an 8-bit color field divided into twelve display slices could be "A7A4A6A0A7A5A1A2A7A6A3A7", i.e., display of the A7 bit plane, followed by display of the A4 bit plane, followed by display of the A6 bit plane, etc.

Figure 4:
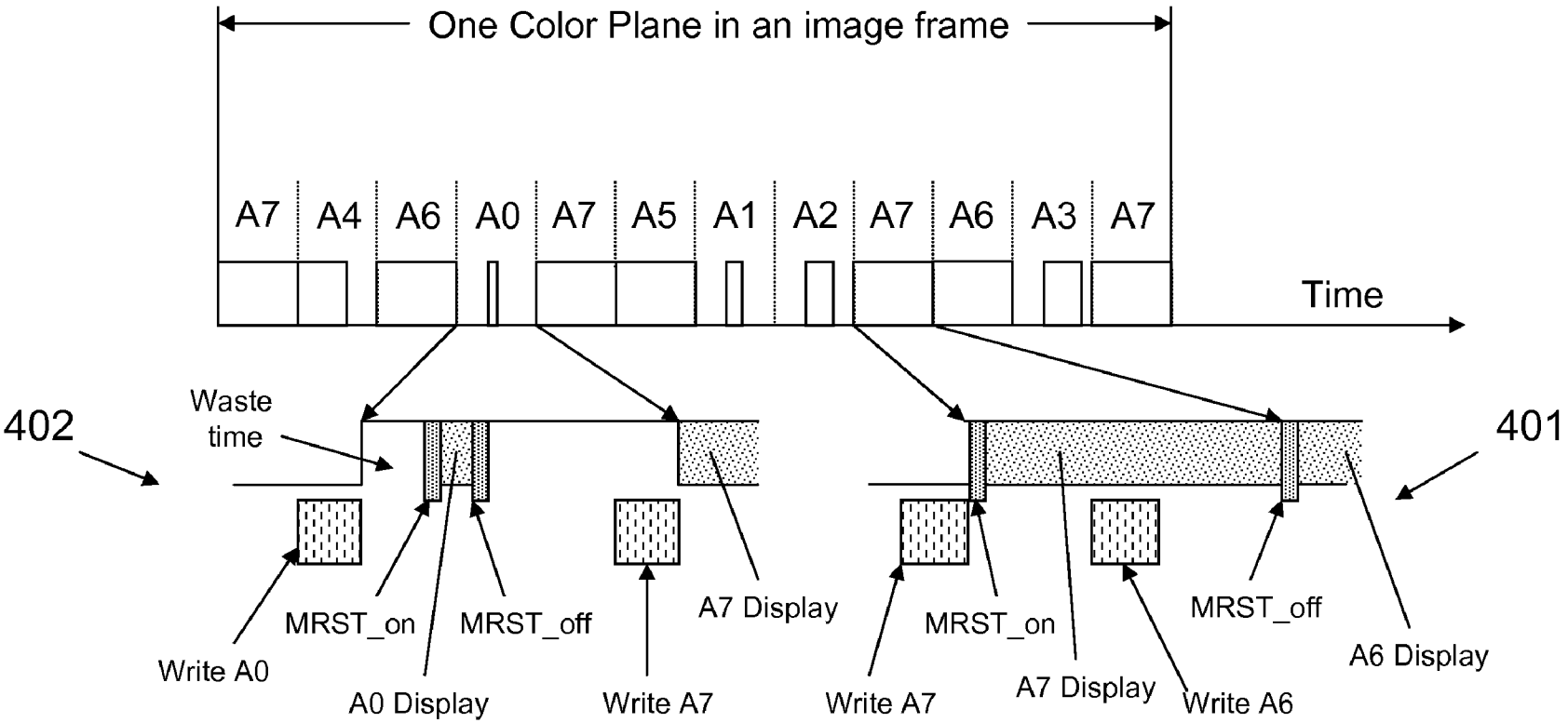
Figure 4 (Prior Art)
FIG. 4 is a schematic illustration of a display sequence at a pixel cell in a color plane in a conventional SLM system.

A conventional display device can include one storage device in each pixel cell. As an example, the display sequence "A7A4A6A0A7A5A1A2A7A6A3A7" for a conventional display system is shown in FIG. 4. The enlarged "write" and "display" sequence 401 includes a display based on an A7 bit plane followed immediately by a display of an A6 bit plane. Since the display time of 320 μs for the display slice for the A5 bit plane is longer than the write time of 100 μs, the display is already written when the display of the display slice for the A7 bit plane is completed. The A6 bit plane can be immediately displayed right after the display of the A7 bit plane. The display efficiency is lower, however, for a bit plane with a shorter display time.

A drawback of the "write" and "display" scheme in the conventional SLM system is in the wasted non-display times within a display slice for a less significant bit. The enlarged "write and display" sequence 402 in FIG. 4 shows a display of the A0 bit plane followed by a display of the A7 bit plane. Since the display time D0 for the A0 bit plane only lasts 10 μs while the data write time for the A7 bit plane takes 100 μs, a micro mirror 210 has to wait for the completion of the data update before the micro mirror 210 can be tilted to the "on" position to direct light to the display image. A long non-display time thus exists after the display of A0 bit plane while waiting for data writing of the A7 bit plane. The long non-display time represents a waste and inefficiency in the conventional SLM system. Similarly, the data write time of 100 μs is also longer than the display times for other lower significance bit planes, e.g., bit planes A1 through A3. Similarly, different amounts of non-display times also exist in association with A1-A3 bit planes because they are all shorter than the write time of 100 μs. In other words, the data write becomes a bottleneck for the SLM system for the low bits' display times. The bottleneck in the data write can exist in conventional SLM systems having different image resolutions, bit display times, and write times. The problem can become particularly severe for larger pixel arrays or higher pixel bit depth. The increased array sizes can increase the data write time. The increased pixel bit-depth may shorten the display times for the low bits. Both effects can increase the gaps between the data write time and the low bit display times, thus further reducing the efficiency of the SLM system.

Figure 5A:
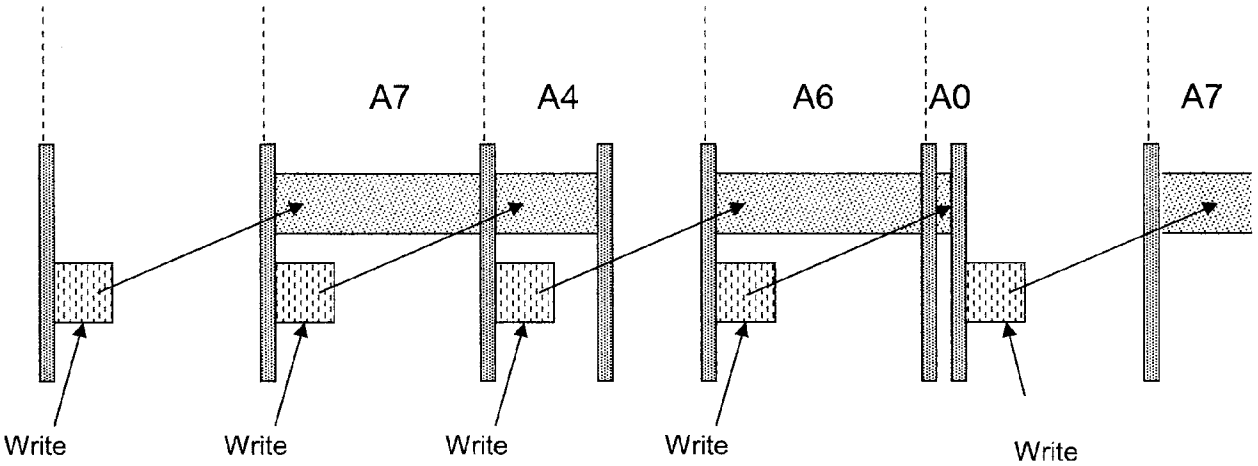
Figure 5A (Prior Art)
FIG. 5A is a schematic illustration of a display sequence (A7A4A6A0A7) at a pixel cell in a conventional SLM system, with a fixed display slice based on A5.

A "write" and "display" sequence implemented in some convention SLM systems is shown FIG. 5A. The "write" and "display" sequence includes a bit-plane sequence A7A4A6A0A7. A fixed display unit is selected, for example, to be the A5 bit plane. The pixel cell includes only one type of "write" action. The display slice (based on A5 bit plane) is selected such that the base display time (e.g., 320 μs) is longer than the write time (e.g., 100 μs). The "write" action for the next bit is conducted while the current bit plane is being displayed. Because the base display time (for the A5 bit plane) is longer than some of the bit planes (e.g., A0-A4 bit planes), the "display" sequence includes gaps in the display sequence, which represents a waste in the display cycle times.

In contrast to the convention display systems, the presently disclosed systems and methods can reduce or eliminate non-display times between the display slices in the conventional display systems by using two "write" events in a pixel cell. In addition, the presently disclosed system does not restrain the less significant bit planes to fixed display units. The SLM system 100 includes two SRAMs 240 and 245 in each pixel cell 200, which can both write data for the display into the pixel cell 200. The SLM system 100 and the pixel cell 200 can improve the display efficiency of an SLM by allowing two data writings in the background during a display slice. The two background writings can be achieved by the dual SRAMs 240 and 245 in the pixel cell 200. The two SRAMs 240 and 245 are written to in sequence to improve, e.g., maximize, the display efficiency.

Figure 5B:
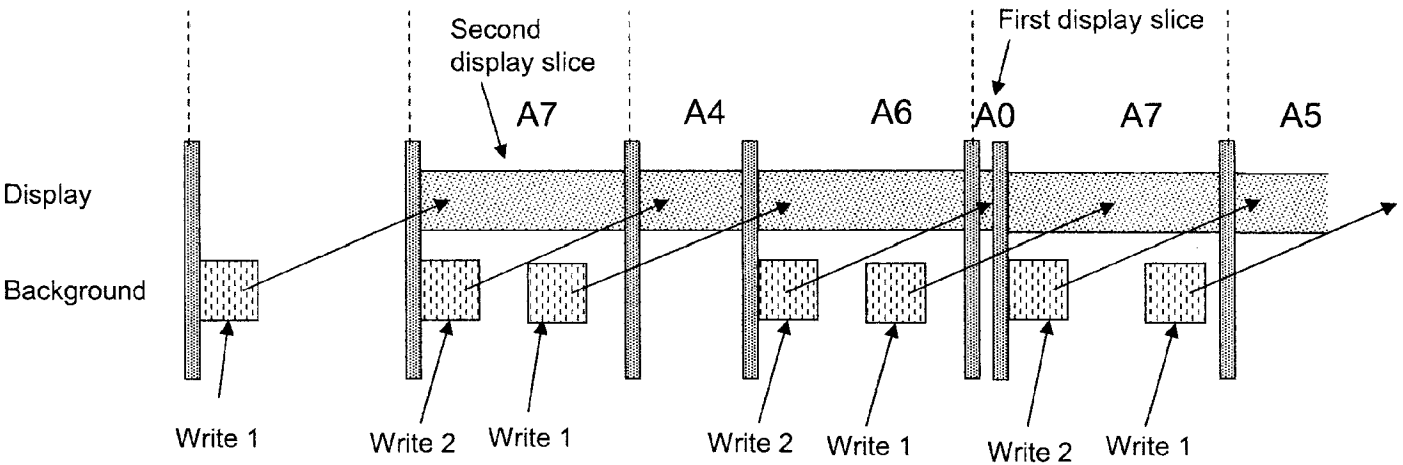
FIG. 5B is a schematic illustration of a display sequence (A7A4A6A0A7A5 . . .) at a pixel cell in an SLM system with variable display units.

As shown in FIG. 5B, the "write" and "display" sequence (e.g., A7A4A6A0A7A5 . . . ) can include "write 1" by the SRAM 240 and "write 2" by the SRAM 245. In the "write 1" and the "write 2" events, the data stored in the SRAMs 240 and 245 can be respectively written to the level shifter 230 under the control of the display enable signals "DE0" and "DE1". The controller controlling the DE0 and DE1 is configured with the write and display sequence and controls the display enable signals according to the sequence. In particular, the controller causes the display enable signals to allow the data in each SRAM to be sent to the level shifter, and therefore the mirror, at the appropriate time, that is, during a display slice that is longer than the write time for the two SRAMs.

In the presently disclosed system, the duration of the display slices can differ, with display slices for less significant bits taking less time. One of the bit planes can be selected to define the maximum duration of a display slice. Thus, the display slices for the bit planes that are less significant than the bit plane corresponding to the maximum duration of a display slice can have differing durations (in particular, the duration can be proportional or equal to the display time for that bit plane). However, the display slices for the selected and more significant bit planes can have the same duration (i.e., the duration for the bit plane corresponding to the maximum duration of a display slice). For example, assuming that the A5 bit plane is selected to define the display slice, the duration for the display slices for the A5, A6 and A7 bit planes can be 320 μs. The bit planes that are more significant than the selected bit plane can occupy a number of display slices equal to the display time for the more significant bit plane divided by the display time for the selected bit plane.

The number of display slices for the selected and more significant bit planes can be equal to or greater than the number of display slices for the less significant bit planes. For example, assuming that the A5 bit plane is selected to define the maximum duration of a display slice, the less significant bit planes will use five display slices (one each for A0, A1, A2, A3 and A4), whereas the selected and more significant bits will use seven display slices (one for A5, two for A6 and four for A7). In addition, the display units for the selected and more significant bit planes can have a duration equal to or greater than the twice the write time.

One or two "write" events can be conducted during a display slice. For instance, "write 2" and "write 1" can occur (referred to as background write or pipelined write and display operation) during a display slice for the A7 bit plane because the total time of 200 μs for the two "write" events is shorter than the duration of the display slice at 320 μs. The "write 2" and "write 1" events during the display slice for the A7 bit plane can provide data for the subsequent display slices for the A4 and A6 bit planes. Similarly, two write events "write 2" and "write 1" can also be arranged to occur during a display slice for the A6 bit plane to prepare for display slices of the A0 and A7 bit planes. The next two write events "write 2" and "write 1" can occur during the display slices of the next A7 bit plane to prepare for the next display slice of the bit plane A5, and so on. Since data can be prepared by the SRAMs 240 and 245 prior to the display of the subsequent bit planes, the display sequence shown in FIG. 5B does not include many of the lapses between the displays of bit planes in the display sequence in a convention SLM system.

The display sequence, that is, the sequence of display slices during a frame, can be ordered so that sufficiently long display slices for writing from the SRAMs precede display slices that are shorter than two write events. In some embodiments, the display sequence includes paired display slices, where a short display slice is paired with a display slice that is at least as long as the write event for the two SRAMs, e.g., A4 paired with A6, A0 paired with A7, as shown in FIG. 5B. Such pairing can eliminate the wasted display time in FIG. 5A. The first display slice can have a first period of display time by the SLM while the second display slice can have a second period of display time by the SLM. The first period of time can be longer than the second period of time. Two consecutive write events can occur after the display of the shorter display slice and during the first period of display time to prepare display data for the subsequent one or more display slices. The first period of time can differ from the second period of time by a factor of two, four, or more. For example, an A0 bit plane can be paired with an A5, an A6 or an A7 bit plane. An A1 bit plane can be paired with an A5, A6, or an A7 bit plane. The pairing of the long display slice and the short display slice allow two write events to be packed into the long display slice for writing data for the next two display slices. That is, the paired display slices can be arranged to display the short display slice first, so that the corresponding SRAM can be freed up for the update during the display of the following longer display slice. Once SRAM data is transferred to the level-shifter and the SLM mirror is flipped, the SRAM content is no longer needed and can be re-written with the new data for the next paired display slice.

It is understood that the pixel cell 200 can operate under other control sequences. For example, data for two bit planes can be written to the two SRAMs in pixel cell during the display of a display slice. Mirror reset signals can by-pass the SRAMs 240 and 245 and to write either "0" or "1" data directly to the level shifter 230 to set the level shifter 230 to a definite output state and prevent the level shifter 230 from floating. Relatively high voltage output from the level shifter 230, if left floating, can damage the low voltage circuits in the pixel cell 200 and the SLM system 100. The SRAMs 240 and 245 can be freed up for a background "write". Once one or two SRAMs 240 and 245 are ready and before a mirror reset pulse is applied to the mirror 210, an SRAM 240 or 245 can output the data to the level shifter 230 to replace the global reset signal to keep the level-shifter 230 at a proper output level. The control sequence allows data for two bit planes to be written to the two SRAMs as long as the current bit plane is longer than the sum of the two write times.

An advantage of the disclosed SLM system is that it provides a higher data writing rate than conventional SLM systems. Image data are stored by two or more SRAMs for each pixel cell. The image data stored on the two or more SRAMs can be written to the SLM in the pixel cell while the SLM device is directing light in corresponding to the previous bit plane. The image data can thus be ready for the next display event at the SLM once the current display event is completed. The non-display times can be reduced or eliminated in comparison with the conventional SLM systems. The disclosed system and methods are particularly beneficial for high resolution and high bit-depth display applications. These applications tend to have long non-display times because of the longer data write times associated with the large pixel arrays and/or the short display times in the low bit displays. The disclosed system can also consume less power than conventional SLM systems by writing data to the pixel cells using lower-voltage signals. The lower-voltage signals are converted to median voltage signals by level-shifters, wherein the median-voltage signals are used to drive the SLMs.

An advantage of the disclosed SLM system is that a whole array of micro mirrors in the pixel array 110 can be simultaneously updated by a single mirror reset pulse (RST0 or RST1), which can minimize mirror update times compared to sequential updates of mirror plates from pixel cell to pixel cell in some convention SLM display system. Mirror reset can occur at the beginning and ending of a display slice. Display efficiency is thus improved in the disclosed SLM system.

It is understood that the disclosed systems and methods are compatible with other configurations of SLM devices and fabrication technologies. For example, the disclosed SLM system is compatible with contact type micro mirrors or non-contact micro mirrors. The disclosed systems and methods are not limited to the specific circuitry design disclosed above. The parameters used above are meant to be examples for illustrating the operations of the disclosed SLM system. The disclosed pixel cell and "write" and "display" sequences can be applied to different image resolutions, bit display times, write times, and different color planes of a color display image. Moreover, the specific bit-plane and display-unit schemes used above are only meant to illustrate the operations of the disclosed system and methods. The disclosed system is compatible with many possible bit-plane and display-unit arrangements. The mirror reset time, the global reset time, and the time duration for a bit plane can all be different from the examples described above. Furthermore, the disclosed system and methods are compatible with a variety of SRAM configurations and different level shifter designs. For example, a pixel cell can include more than two SRAMs that can alternately write data to a level shifter for display.

What is claimed is:

1. A spatial light modulator system, comprising:

an array of pixel cells each comprising:

two static random access memory (SRAM) devices each configured to store digital data and perform a write event that takes a minimum time period;

a spatial light modulator configured to output light in an on direction or an off direction according to the write event; and a controller configured with a display sequence, the display sequence including a first display slice and a second display slice, the first display slice having a display time less than two times the minimum time period and the second display slice having a display time of more than two times the minimum time period, wherein the controller controls write events from the two SRAM devices, and the first display slice and second display slice are ordered in the display sequence so that the controller is configured to cause the spatial light modulator to output light and the two SRAM devices to each perform a write event during the second display slice.

2. The spatial light modulator system of claim 1, wherein the write event produces a first voltage signal in the range of about 1.3 to 2.3 volts.

3. The spatial light modulator system of claim 1, further comprising a level shifter configured to receive the write event from the SRAM devices.

4. The spatial light modulator system of claim 3, wherein the level shifter outputs a second voltage signal in the range of about 4 to 6 volts.

5. The spatial light modulator system of claim 4, wherein the spatial light modulator includes a micro mirror plate configured to receive a reset signal, and further includes one or more electrodes.

6. The spatial light modulator system of claim 5, wherein the one or more electrodes are configured to receive the second voltage signal from the level shifter, and the micro mirror plate is configured to tilt in response to a third voltage signal and the second voltage signal.

7. The spatial light modulator system of claim 6, wherein the third voltage signal is in the range of about 15 to 50 volts.

8. The spatial light modulator system of claim 7, wherein the third voltage signal is in the range of about 20 to 40 volts.

9. The spatial light modulator system of claim 1, further comprising a multiplexer configured to select one of the two SRAM devices in response to an external signal, wherein a selected SRAM of the two SRAM devices is configured to write data to a level shifter.

10. The spatial light modulator system of claim 9, wherein the level shifter is configured to receive a global reset signal and to reset the spatial light modulator to a predetermined position in response to the global reset signal.

11. The spatial light modulator system of claim 10, wherein the spatial light modulator includes a tiltable micro mirror plate supported by a substrate, wherein the micro mirror is configured to tilt to an on position to direct the light in the on direction or an off position to direct the light to the off direction in response to the global reset signal.

12. The spatial light modulator system of claim 9, wherein the level shifter comprises a plurality of MOSFET devices.

13. The spatial light modulator system of claim 12, wherein two of the plurality of MOSFET devices in the level shifter form a cross-coupled latch.

14. The spatial light modulator system of claim 1, wherein each of the at least two SRAM devices comprises a plurality of MOSFET devices.

15. The spatial light modulator system of claim 1, wherein the spatial light modulator includes a tiltable micro mirror plate supported by a substrate and one or more electrodes under the micro mirror plate.

* * * * *